US008163450B2

(12) United States Patent
Kishida

(10) Patent No.: US 8,163,450 B2
(45) Date of Patent: Apr. 24, 2012

(54) TONER, AND IMAGE FORMING APPARATUS AND IMAGE FORMING METHOD USING THE TONER

(75) Inventor: Hiroyuki Kishida, Numazu (JP)

(73) Assignee: Ricoh Company Limited, Tokyo (JP)

( * ) Notice: Subject to any disclaimer, the term of this patent is extended or adjusted under 35 U.S.C. 154(b) by 558 days.

(21) Appl. No.: 12/367,750

(22) Filed: Feb. 9, 2009

(65) Prior Publication Data

US 2009/0214966 A1 Aug. 27, 2009

(30) Foreign Application Priority Data

Feb. 22, 2008 (JP) ..... 2008-041105
Nov. 17, 2008 (JP) ..... 2008-293063

(51) Int. Cl.
*G03G 9/08* (2006.01)

(52) U.S. Cl. ..... 430/108.2; 430/108.3; 430/108.4; 430/108.6; 430/108.7; 430/123.51

(58) Field of Classification Search ..... 430/108.3, 430/108.4, 108.7, 108.6, 108.2, 123.51; 399/269
See application file for complete search history.

(56) References Cited

U.S. PATENT DOCUMENTS

| | | | | |
|---|---|---|---|---|
| 5,416,571 | A | 5/1995 | Yamada et al. | |
| 5,630,201 | A * | 5/1997 | Suzuki et al. | 399/269 |
| 5,923,933 | A * | 7/1999 | Anzai et al. | 399/269 |
| 6,160,142 | A * | 12/2000 | Sawada et al. | 554/158 |
| 2004/0219448 | A1* | 11/2004 | Kato et al. | 430/108.6 |
| 2006/0222995 | A1* | 10/2006 | Moriyama et al. | 430/122 |
| 2007/0184377 | A1 | 8/2007 | Shu et al. | |

FOREIGN PATENT DOCUMENTS

| | | |
|---|---|---|
| JP | 6-202484 | 7/1994 |
| JP | 9-197932 | 7/1997 |
| JP | 2004-325621 | 11/2004 |
| JP | 2006-227190 | 8/2006 |
| JP | 2007-78925 | 3/2007 |
| JP | 2007-108622 | 4/2007 |
| JP | 2007-132999 | 5/2007 |
| JP | 2007-241166 | 9/2007 |
| JP | 2007-241241 | 9/2007 |

OTHER PUBLICATIONS

Derwent abstract describing JP 08-286503 A, Acc. No. 1996-413758, copyright 2011, which was entered in DERWENT in 2003.*
IBM Operator's Guide for Infoprint 4000 and Infoprint 4100 Models, fourth edition (Apr. 2003), IBM Printing Systems Company, Boulder, CO, copyright 2003, pp. 3-5.*

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A toner including toner particles; and external additives including a fatty acid metal salt having an average primary particle diameter of from 0.5 to 1.5 μm; a positively chargeable particulate inorganic material; and a negatively chargeable particulate inorganic material. An image forming apparatus including a photoreceptor bearing an electrostatic image, and a center feed developing device configured to develop the electrostatic image with a developer including the toner to form a toner image, and a transfer device configured to transfer the toner image onto a receiving material preferably fed at a speed of from 500 to 1700 mm/s. An image forming method including forming an electrostatic image, developing the electrostatic image with the center feed developing device using the toner to form a toner image, and transferring the toner image onto a receiving material preferably fed at a speed of from 500 to 1700 mm/s.

7 Claims, 2 Drawing Sheets

TONER, AND IMAGE FORMING APPARATUS AND IMAGE FORMING METHOD USING THE TONER

BACKGROUND OF THE INVENTION

1. Field of the Invention

The present invention relates to a toner. In addition, the present invention also relates to an image forming apparatus and an image forming method, which form images using a developer including the toner.

2. Discussion of the Background

Recently, a need exists for high speed image formation in electrophotography. Specifically, super high speed image forming apparatus having a system speed of from 500 to 1700 mm/s are required to stably develop an electrostatic image formed on a photoreceptor and to prevent a toner filming problem in that a toner film (typically a film of a release agent included in the toner but released therefrom) is formed on the photoreceptor, resulting in deterioration of image qualities.

In attempting to fulfill the request, published unexamined Japanese patent application No. (hereinafter referred to as JP-A) 06-202484 (i.e., Japanese patent No. 3128745, i.e., U.S. Pat. No. 5,416,571) discloses a developing device in which at least two developing rollers (backward developing rollers) are arranged in the vicinity of a photoreceptor while rotated in the opposite direction of that of the photoreceptor, and at least one developing roller (forward developing roller) is arranged in the vicinity of a photoreceptor and on an upstream side from the two backward developing rollers relative to the rotating direction of the photoreceptor while rotated in the same direction as that of the photoreceptor. It is described therein that by using such a developing device, image shaving proper image density can be stably produced even at a high speed. However, the toner filming problem is not mentioned therein.

In attempting to solve the toner filming problem, a number of proposals such that a cleaning process is performed on a photoreceptor to remove residual toner particles therefrom after a toner image is transferred from the photoreceptor to an intermediate transfer medium or a receiving material and before the photoreceptor is charged to form the following image have been made. For example, JP-A 2007-132999 discloses a cleaning process using a brush, JP-A 2004-325621 discloses a cleaning process using a blade, and JP-A 09-197932 discloses a cleaning process using a roller. However, particles of the toners used for forming toner images have a variety of forms. Therefore, even when performing such cleaning processes, it is difficult to remove all the toner particles from photoreceptors. In addition, photoreceptors tend to be deteriorated when rubbed by such cleaning members. Therefore, performing a cleaning process using such cleaning members is not a good solution.

In order to solve the toner film problem from the toner side, JP-As 2007-241166, 2007-108622, 2007-78925 and 2006-227190 have proposed toners including a fatty acid metal salt as an external additive thereof. By using a fatty acid metal salt as an external additive, the resultant toners tend to have good filming resistance. However, adding a fatty acid metal salt deteriorates fluidity of the resultant toners. Therefore, it is not proper to use such toners for super high speed image forming apparatus. In addition, conventional fatty acid metal salts have a relatively large particle diameter of not less than 2 μm. Therefore, it is not preferable to use such fatty acid metal salts as external additives.

Because of these reasons, a need exists for a super high speed image forming apparatus, which can produce images with proper image density without causing the toner filming problem.

SUMMARY OF THE INVENTION

As an aspect of the present invention, a toner is provided, which includes toner particles, and external additives including a fatty acid metal salt having an average primary particle diameter of from 0.5 to 1.5 μm, a positively chargeable particulate inorganic material, and a negatively chargeable particulate inorganic material.

As another aspect of the present invention, an image forming apparatus is provided, which includes:

a photoreceptor configured to bear an electrostatic image thereon;

a center feed developing device configured to develop the electrostatic image using a developer including the toner mentioned above to form a toner image on the photoreceptor, wherein the developing device includes:

at least two developing rollers each having a magnetic attraction force, wherein the at least two developing rollers are opposed to the photoreceptor and rotated in the directions opposite to each other; and a developer layer controlling member configured to form a developer layer on each of the at least two developing rollers; and a transfer device configured to transfer the toner image onto a receiving material.

The receiving material is preferably moved at a linear system speed of from 500 to 1700 mm/s.

As yet another aspect of the present invention, an image forming method is provided, which includes:

forming an electrostatic image on a photoreceptor;

developing the electrostatic image using the above-mentioned center feed developing device, which develops the electrostatic image using a developer including the toner mentioned above to form a toner image on the photoreceptor; and transferring the toner image onto a receiving material.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
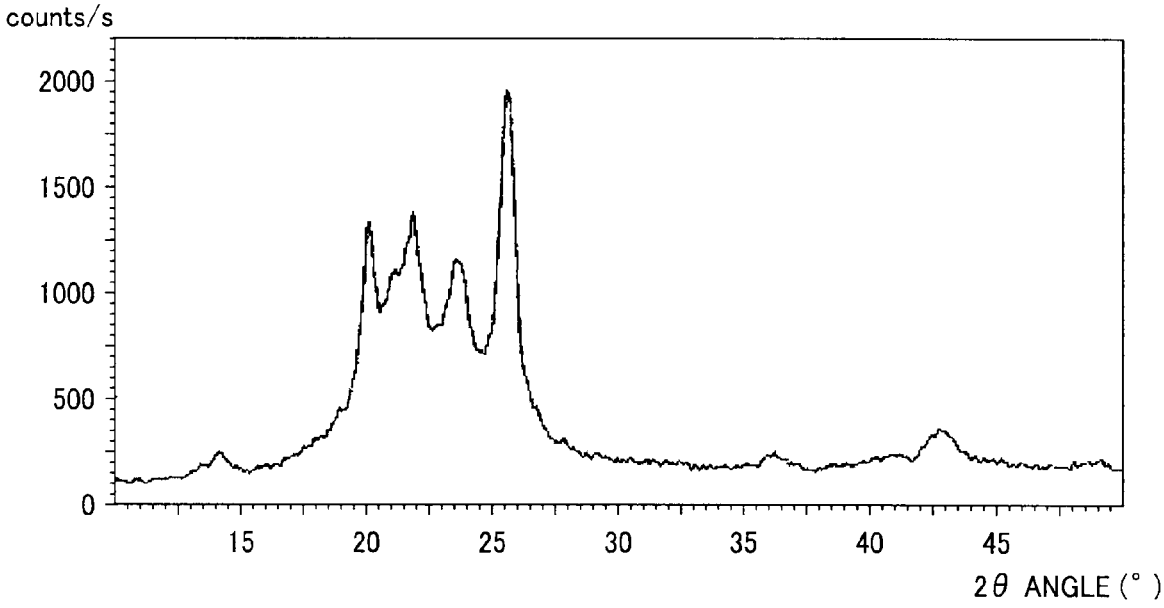
FIG. 1 is an X-ray diffraction spectrum of the crystalline polyester resin synthesized in Example 1.

The present inventor has studied the mechanism of occurrence of the image density problem and the toner filming problem specific to super high speed image forming apparatus using a center feed developing device, and discovers the solution of the problems.

In order to produce high density images using a super high speed image forming apparatus having a linear speed of from 500 to 1700 mm/s, it is not preferable to use a developing device having only one magnetic developing roller and it is preferable to use a center feed developing device, which uses plural magnetic developing rollers to increase the developing time. Developing devices using plural magnetic developing rollers have higher developing ability than developing devices having only one magnetic developing roller. Therefore, high density images can be produced even when the images have a large image area.

In such super high speed image forming apparatus, toner particles remaining on the photoreceptor even after an image transfer process cannot be well removed therefrom by a cleaner because the peripheral speed of the photoreceptor is high. Such residual toner tends to be fixedly adhered to the photoreceptor, resulting in formation of a toner film on the photoreceptor, thereby forming a white spot on a solid image.

In order to solve the toner filming problem, it is important to improve the toner transfer rate and it is preferable to include a fatty acid metal salt in the toner as an external additive. The reason why such an external additive is effective is not yet determined but is considered to be as follows.

When a fatty acid metal salt (external additive) of a toner is contacted with a photoreceptor, the fatty acid metal salt forms a layer on the surface of the photoreceptor, resulting in improvement of toner releasability of the photoreceptor, i.e., improvement of toner image transferability of the photoreceptor. However, by adding a fatty acid metal salt to a toner, the fluidity of the toner tends to deteriorate, and the toner cannot be well agitated in a developing device, thereby insufficiently charging the toner, resulting in formation of a background development problem in that the background of images is soiled with toner particles.

The point of the present invention is to use a combination of a fatty acid metal salt, a positively chargeable inorganic material, and a negatively chargeable inorganic material as external additives of a toner in order to impart good fluidity to the toner. Specifically, by adding a negatively chargeable inorganic material to mother toner particles (i.e., toner particles without an external additive), the fluidity of the toner particles can be improved. In addition, by adding a positively chargeable inorganic material to mother toner particles, the charge rising property of the toner particles can be controlled, thereby preventing occurrence of the background development problem at an initial stage (i.e., when the toner is initially used). This technique is effective for super high speed image forming apparatus, but is not necessarily effective for middle or low speed image forming apparatus having a system speed of lower than 500 mm/s. If any one of a fatty acid metal salt, a positively chargeable inorganic material, and a negatively chargeable inorganic material is not added, the problems cannot be solved.

It is very important to use a fatty acid metal salt having an average primary particle diameter of from 0.5 to 1.5 μm as an external additive of the toner of the present invention. When the average primary particle diameter of the added fatty acid metal salt is smaller than 0.5 μm, the fatty acid metal salt tends to be embedded into recessed portions of toner particles, resulting in deterioration of the filming resistance of the toner. In contrast, when the average primary particle diameter of the added fatty acid metal salt is greater than 1.5 μm, the fatty acid metal salt cannot be well fixed to the surface of the toner, resulting in deterioration of the filming resistance of the toner. In this regard, the average primary particle diameter of a fatty acid metal salt is determined with a laser diffraction particle size analyzer from Shimadzu Corp.

The measuring method is as follows.

At first, 0.01 g of a sample and 0.1 g of a surfactant are mixed in a 100 ml beaker so that the mixture becomes a semitransparent paste. Next, 40 g of refined water is added to the mixture to lightly disperse the paste in water. Further, the paste is subjected to a supersonic treatment for 4 minutes to prepare a dispersion of the sample. One (1) gram of the dispersion is contained in a cell to measure the volume average particle diameter (D50) of the sample, which is defined as the average primary particle diameter in the present application.

The added amount of a fatty acid metal salt is preferably from 0.01 to 1.0 parts by weight, and more preferably from 0.02 to 0.06 by weight, per 100 parts by weight of toner particles (mother toner). In addition, the ratio (hereinafter referred to as free particle ratio) of the fatty acid metal salt released from the toner particles, which is determined by subjecting the toner to a super sonic vibration treatment, is preferably from 10 to 20% by weight. When the free particle ratio is too small, a good combination of environmental stability, transferability and cleanability cannot be imparted to the toner. In contrast, when the free particle ratio is too large, the free particles deteriorate the fluidity of the toner. In addition, the toner filming problem can be caused.

The method for determining the free particle ratio is as follows.

At first, 4.4 ml of a surfactant (DRYWELL from Fuji Photo Film Co., Ltd.) having a solid content of 33% by weight is added to 100 ml of ion-exchange water, and the mixture is agitated for 1 minute to prepare a solution A. Next, 5 g of a sample toner is added to the solution A. The mixture is shaken 20 times, and then allowed to settle for 30 minutes to prepare a liquid B. The liquid B is then shaken 5 times to disperse the toner therein. Further, the vibrating member of a supersonic homogenizer (VCX750 from Sonics & Materials, Inc) is dipped into the liquid B in a length of 2.5 cm to vibrate the liquid B at an output energy of 30%, resulting in formation of a liquid C. After the liquid C is allowed to settle for 10 minutes, the liquid C is filtered using a filter paper with a diameter of 110 mm, i.e., 100CIRCLES from Toyo Roshi Kaisha. The toner particles on the filter paper are dried for 8 hours in a constant temperature chamber heated to 40° C. Next, 3 g of the thus dried toner particles are pressed for 60 seconds at a load of 6.0 t using an automatic briquetting press machine (T-BRB-32 from Maekawa Testing Machine Mfg. Co., Ltd.) to prepare a pellet of the treated toner having a diameter of 3 mm and a thickness of 2 mm. In this case, a pellet of the original toner (i.e., the non-treated toner) having a diameter of 3 mm and a thickness of 2 mm is also prepared by the same pressing method. The content of the metal (included in the fatty acid metal salt used as an external additive) in each of the toner pellets is determined using a fluorescent X-ray analyzer (ZSX-100e from Rigaku Corp.) and a working curve. In this regard, the working curve of the metal content is previously prepared by making toners including the metal in amounts of 0.1, 1 and 1.8 parts by weight based on the total weight of the toner, and subjecting the toners to the X-ray analysis.

The free particle ratio (FPR) of the fatty acid metal salt is determined by the following equation:

$$FPR(\%)=\{(M0-M1)/M0\}\times 100$$

wherein M0 represents the metal content of the original toner (i.e., non-treated toner), and M1 represents the metal content of the treated toner.

Specific examples of the fatty acid metal salts for use as external additives include zinc stearate, calcium stearate, magnesium stearate, aluminum stearate, zinc oleate, zinc palmitate, magnesium palmitate, zinc myristate, zinc laurate, and zinc behenate, but are note limited thereto. Among these materials, zinc stearate, zinc laurate, zincmyristate, calcium stearate and aluminum stearate are preferably used.

Specific examples of the positively or negatively chargeable inorganic materials include silica, alumina, titanium oxide, barium titanate, magnesium titanate, calcium titanate, strontium titanate, iron oxide, copper oxide, zinc oxide, tin oxide, quartz sand, clay, mica, sand lime, diatom earth, chromium oxide, cerium oxide, red iron oxide, antimony trioxide, magnesiumoxide, zirconiumoxide, bariumoxide, barium carbonate, calcium carbonate, silicon carbide, and silicon nitride, but are not limited thereto. Among these materials, silica and titanium oxide are preferably used.

In the present application, the positively and negatively chargeable inorganic materials are defined as follows.

A mother toner (i.e., particles of a toner without an external additive) and an inorganic material (serving as an external additive) are mixed to prepare a toner, and then the quantity of charges of the toner is measured. If the difference between the charge amount of the toner and that of the mother toner is positive, the inorganic material is defined as a positively chargeable inorganic material. If the difference is negative, the inorganic material is defined as a negatively chargeable inorganic material.

The charge amount measuring method is the following blow-off charge amount measuring method.

Specifically, 0.4 g of a sample (toner or mother toner) and 96 g of a ferrite are fed into a polypropylene container. The container is set on a double-axis rotor and rotated for 15 minutes at a revolution of 100 rpm. Next, 0.05 g of the mixture is set on a 500-mesh metal screen and subjected to a blow-off treatment to measure the charge amount of the sample using a blow-off powder charge amount measuring instrument TB-200 from Toshiba Chemical Corp. The blow-off conditions are as follows.

Pressure of nitrogen gas used for blow-off: 0.5 kg/cm$^2$

Blow-off time: 20 seconds

Silicas for use as positively chargeable inorganic materials preferably have a volume average particle diameter of from 10 to 100 nm, and more preferably from 10 to 60 nm, in view of fluidity of the resultant toner. When the average particle diameter is too large, the fluidity of the resultant toner deteriorates. In contrast, when the average particle diameter is too small, the silicas tend to cause secondary aggregation. In this case, it is difficult for such secondarily aggregated silicas to adhere to free particles of the release agent released from the mother toner, resulting in occurrence of the filming problem.

The added amount of a silica serving as a positively chargeable inorganic material is preferably from 0.5 to 2 parts by weight, and more preferably from 0.7 to 1.5 parts by weight, per 100 parts by weight of the mother toner. When the added amount is too small, it is difficult for such a silica to adhere to free particles of the release agent released from the mother toner. In contrast, when the added amount is too large, the covering ratio of the silica (i.e., the ratio of area of the surface covered with the silica) seriously increases, resulting in deterioration of the fixing properties of the toner.

Silicas serving as positively chargeable inorganic materials are preferably subjected to a hydrophobizing treatment to improve the fluidity and charging properties of the resultant toner. Specific examples of the hydrophobizing agents include silane compounds such as hexamethyldisilazane, and dimethyldichlorsilane; silicone oils such as dimethylsilicone, methylphenylsilicone, fluorine-containing silicone oils, alkyl-modified silicone oils, amino-modified silicone oils, and epoxy-modified silicone oils; etc. The hydorophobizing treatment is performed using a wet method or a dry method.

Specific examples of the positively chargeable silicas include H30TA from Wacker Chemie AG, having a volume average particle diameter of 8 nm and treated with polydimethylsiloxane; MSP-005 from Tayca Corp., having a volume average particle diameter of 20 nm and treated with silane; TG-820F from Cabot Corp., having a volume average particle diameter of 11 nm and treated with a silicone oil; etc.

Silicas serving as negatively chargeable inorganic materials preferably have a volume average particle diameter of from 10 to 50 nm, and more preferably from 15 to 30 nm. When the volume average particle diameter is too large, the fluidity of the toner deteriorates. In contrast, when the volume average particle diameter is too small, the silicas tend to cause secondary aggregation. In this case, it is difficult for such secondarily aggregated silicas to adhere to particles of the release agent released from the mother toner, resulting in occurrence of the filming problem. Silicas serving as negatively chargeable inorganic materials are preferably subjected to a hydrophobizing treatment to improve the fluidity and charging properties of the resultant toner. In this regard, the hydrophobizing treatment is performed by a method similarly to the above-mentioned method to be used for positively chargeable silicas.

The added amount of a silica serving as a negatively chargeable inorganic material is preferably from 0.5 to 2 parts by weight, and more preferably from 0.7 to 1.5 parts by weight, per 100 parts by weight of the mother toner. When the added amount is too small, it is difficult for such a silica to adhere to particles of the release agent released from the mother toner. In contrast, when the added amount is too large, the covering ratio of the silica (i.e., the ratio of area of the surface covered with the silica) seriously increases, resulting in deterioration of the fixing properties of the toner.

Specific examples of the negatively chargeable silicas include RX200 from Nippon Aerosil Co., having a volume average particle diameter of 10 nm and treated with hexamethyldisilazane; RY200 from Nippon Aerosil Co., having a volume average particle diameter of 10 nm and treated with a silicone oil; RX50 from Nippon Aerosil Co., having a volume average particle diameter of 50 nm and treated with hexamethyldisilazane; TG-811F from Cabot Corp., having a volume average particle diameter of 10 nm and treated with hexamethyldisilazane; TG-308F from Cabot Corp., having a volume average particle diameter of 15 nm and treated with a silicone oil; etc.

Titanium oxides serving as positively chargeable inorganic materials and negatively chargeable inorganic materials preferably have a volume average particle diameter of from 10 to 50 nm, and more preferably from 15 to 30 nm. When the volume average particle diameter is too large, the fluidity of the toner deteriorates. In contrast, when the volume average particle diameter is too small, the titaniumoxides tend to cause secondary aggregation. In this case, it is difficult for such secondarily aggregated titanium oxides to adhere to particles of the release agent released from the mother toner, resulting in occurrence of the filming problem.

The added amount of a titanium oxide serving as a positively or negatively chargeable inorganic material is preferably from 0.5 to 2 parts by weight, and more preferably from 0.7 to 1.5 parts by weight, per 100 parts by weight of the mother toner. When the added amount is too small, it is difficult for such a titanium oxide to adhere to particles of the release agent released from the mother toner. In contrast, when the added amount is too large, the covering ratio of the titanium oxide (i.e., the ratio of area of the surface covered with the titanium oxide) seriously increases, resulting in deterioration of the fixing properties of the toner.

Specific examples of the positively chargeable titanium oxides include JMT-150AN0 from Tayca Corp., having a volume average particle diameter of 15 nm and treated with silane, etc.

Specific examples of the negatively chargeable titanium oxides include JMT-150IB from Tayca Corp., having a volume average particle diameter of 15 nm and treated with silane, etc.

In the present application, the volume average particle diameter of a particulate material is determined using a particle size distribution analyzer using an electric resistance method (MULTISIZER III from Beckman Coulter Inc.), and is the average particle diameter (D50) determined from the volume particle diameter distribution.

The toner of the present invention preferably includes a polyester resin as a binder resin. Suitable polyester resins include amorphous polyester resins and crystalline polyester resins. These polyester resins can be used alone or in combination.

Specifically, polycondensation polyester resins such as polyester resins (AX) prepared by subjecting a polyol and a polycarboxylic acid to a polycondensation reaction, and modified polyester resins (AY) prepared by reacting such a polyester resin (AX) with a compound such as polyepoxides (c) can be used as binder resins of the toner. These polyester resins (AX and AY) can be used alone or in combination.

Suitable polyols for use in preparing polyester resins include diols (g) and polyols (h) having three or more hydroxyl groups. Suitable polycarboxylic acids for use in preparing polyester resins include dicarboxylic acids (i) and polycarboxylic acids (j) having three or more carboxyl groups. These polyols can be used alone or in combination, and the polycarboxylic acids can also be used alone or in combination.

Specific examples of the polyester resins (AX) include linear polyester resins (AX1) which are prepared by using a diol (g) and a dicarboxylic acid (i); and non-linear polyester resins (AX 2 ) which are prepared by using a diol (g), a dicarboxylic acid (i) and a polyol (h) and/or a polycarboxlic acid (j).

Specific examples of the modified polyester resins (AY) include modified polyester resins (AY1 ) which are prepared by reacting a non-linear polyester resin with a compound (c).

It is preferable for the diols (g) to have a hydroxyl value of from 180 to 1900 mgKOH/g. Specific examples of the diols (g) include alkylene glycols having 2 to 36 carbon atoms (e.g., ethylene glycol, 1,2-propylene glycol, 1,3-propylene glycol, 1,4-butylene glycol and 1,6-hexanediol); alkylene ether glycols Having 4 to 36 carbon atoms (diethyleneglycol, triethyleneglycol, dipropylene glycol, polyethylene glycol, polypropylene glycol, and polybutylene glycol); alicyclic diols having 6 to 36 carbon atoms (e.g., 1,4-cyclohexane dimethanol, and hydrogenated bisphenol A); adducts of the above-mentioned alicyclic diols with an alkylene oxide having 2 to 4 carbon atoms such as ethylene oxides (EO), propylene oxides (PO) and butylenes oxides (BO) (the added amount of from 1 to 30 moles); adducts of bisphenols (e.g., bisphenol A, bisphenol F and bisphenol S) with an alkylene oxide having 2 to 4 carbon atoms such as ethylene oxides (EO), propylene oxides (PO) and butylenes oxides (BO) (the added amount of from 2 to 30 moles); etc.

Among these diols, alkylene glycols having 2 to 12 carbon atoms, alkylene oxide adducts of bisphenols, and mixtures thereof are preferably used, and alkylene oxide adducts of bisphenols, alkylene glycols having 2 to 4 carbon atoms, and mixtures thereof are more preferably used.

It is preferable for the polyols (h) to have a hydroxyl value of from 150 to 1900 mgKOH/g. Specific examples of the polyols (h) include aliphatic polyalcohols having three or more hydroxyl groups and 3 to 36 carbon atoms (e.g., alkanepolyols, and inner-molecular or inter-molecular anhydrous materials thereof such as glycerin, triethylolethane, pentaerythritol sorbitol, sorbitan, polyglycerin, and dipentaerythritol; saccharides and derivatives thereof such as saccharose and methylglucoside; etc.); adducts of the above-mentioned aliphaticpolyalcohols with an alkylene oxide having2 to 4 carbon atoms such as ethylene oxides (EO), propylene oxides (PO) and butylenes oxides (BO) (the added amount of from 1 to 30 moles); adducts of trisphenols (trisphenol PA) with an alkylene oxide having 2 to 4 carbon atoms such as ethylene oxides (EO), propylene oxides (PO) and butylenes oxides (BO) (the added amount of from 2 to 30 moles); adducts of novolac resins (phenol novolak and cresol novolac having an average polymerization degree of from 3 to 60) with an alkylene oxide having 2 to 4 carbon atoms such as ethylene oxides (EO), propylene oxides (PO) and butylenes oxides (BO) (the added amount of from 2 to 30 moles); etc.

Among these materials, aliphatic polyalcohols and alkylene oxide adducts of novolac resins are preferably used, and alkylene oxide adducts of novolac resins are more preferably used.

It is preferable for the dicarboxylic acids (i) to have an acid value of from 180 to 1250 mgKOH/g. Specific examples of the dicarboxylic acids (i) include alkanedicarboxylic acids having 4 to 36 carbon atoms (e.g., succinic acid, adipic acid, and sebacic acid) and alkenylsuccinic acids (e.g., dodecenylsuccinic acid); alicyclic dicarboxylic acids having 4 to 36 carbon atoms (e.g., dimer acids (such as dimeric linolic acid); alkenedicarboxylic acids having 4 to 36 carbon atoms (e.g., maleic acid, fumaric acid, citraconic acid, and mesaconic acid); aromatic dicarboxylic acids having 8 to 36 carbon atoms (e.g., phthalic acid, isophthalic acid, terephthalic acid and naphthalenedicarboxylic acid); etc. Among these materials, alkanedicarboxylic acids having 4 to 20 carbon atoms and aromatic dicarboxylic acids having 8 to 20 carbon atoms are preferably used. Anhydrides and lower alkyl esters having 1 to 4 carbon atoms (such as methyl, ethyl and isopropyl esters) of the above-mentioned dicarboxylic acids can also be used as the dicarboxylic acids (i).

It is preferable for the polycarboxylic acids (j) having three or more carboxyl groups (three to six carboxyl groups or more carboxyl groups) to have an acid value of from 150 to 1250 mgKOH/g. Specific examples of the polycarboxylic acids (j) include aromaticpolycarboxylic acids having 9 to 20 carbonatoms (e.g., trimellitic acid, and pyromellitic acid); copolymers of vinyl monomers and unsaturated carboxylic acids having a number average molecular weight (Mn) of from 450 to 10,000 determined by a gel permeation chromatography (GPC) (e.g., styrene-maleic acid copolymers, styrene-acrylic acid copolymers, α-olefin-maleicacidcopolymers, and styrene-fumaric acid copolymers) etc. Among these materials, aromatic polycarboxylic acids having 9 to 20 carbon atoms are preferably used, and trimellitic acid and pyromellitic acid are more preferably used. Anhydrides and lower alkyl esters having 1 to 4 carbon atoms (such as methyl, ethyl and isopropyl esters) of the above-mentioned polycarboxylic acids can also be used as the polycarboxylic acids (j).

In the present application, the hydroxyl value and acid value are determined by the method described in JIS K 0070.

In addition, aliphatic or aromatic hydroxycarboxylic acids (k) having 4 to 20 carbon atoms and lactones (1) having 6 to 12 carbon atoms can be used (i.e., copolymerized) in combination with the above-mentioned diols (g), polyols (h), dicarboxylic acids (i) and polycarboxylic acids (j).

Specific examples of the hydroxycarboxylic acids (k) include hydroxystearic acid, hardened caster oil fatty acids, etc. Specific examples of the lactone (1) include caprolactone, etc.

Specific examples of the polyepoxides (c) include polyglycidyl ethers (e.g., ethylene glycol diglycidyl ether, tetramethylene glycol diglycidyl ether, bisphenol A diglycidyl ether, bisphenol F diglycidyl ether, glycerin triglycidyl ether, pentaerythritol tetraglycidyl ether, glycidyl ethers of phenol novolac (average polymerization degree of from 3 to 60); diene oxides (e.g., pentadiene dioxide, and hexadiene dioxide); etc. Among these materials, polyglycidyl ethers are preferably used, and ethylene glycol diglycidyl ether, and bisphenol A diglycidyl ether are more preferably used.

The number of epoxy groups included in a molecule of a polyepoxide (c) is preferably from 2 to 8, more preferably from 2 to 6, and even more preferably from 2 to 4.

The epoxy equivalent of polyepoxides (c) is preferably from 50 to 500. The lower limit is more preferably 70 and even more preferably 80. The upper limit is more preferably 300 and even more preferably 200.

When the number of epoxy groups or the epoxy equivalent falls in the respective ranges mentioned above, the resultant toner has a good combination of developing property and fixing property. It is more preferable that both the number of epoxy groups and the epoxy equivalent fall in the respective ranges mentioned above.

Suitable mixing ratio (i.e., an equivalent weight ratio [OH]/[COOH]) of a polyol to a polycarboxylic acid is from 2/1 to 1/2, preferably from 1.5/1 to 1/1.3 and more preferably from 1.3/1 to 1/1.2. It is preferable to select one or more polyols and one or more polycarboxylic acids such that the resultant polyester resin used as a binder resin of the toner has a glass transition temperature of from 45 to 85° C. while controlling the molecular weight of the polyester resin.

Amorphous polyester resins for use as binder resins of the toner of the present invention can be prepared by conventional methods for use in preparing popular polyesters. For example, monomers are subjected to a polycondensation reaction in an inactive gas atmosphere (such as nitrogen gas) using a titanium-containing catalyst (a). The reaction temperature is preferably from 150 to 280° C., more preferably from 160 to 250° C., and even more preferably from 170 to 240° C. The reaction time is preferably not shorter than 30 minutes, and more preferably from 2 hours to 40 hours in order to perfectly perform the polycondensation reaction. In addition, it is preferable to perform the reaction under a reduced pressure (e.g., 1 to 50 mmHg) in order to enhance the reaction speed at a late stage of the polycondensation reaction.

The titanium-containing catalyst (a) are catalysts having the following formula (I) or (II).

$$Ti(—X)_m(—OH)_n \quad (I)$$

$$O{=}Ti(—X)_p(—OR)_q \quad (II)$$

In formulae, (I) and (II), X represents a residual group of a mono- or polyalkanol amine (i.e., a hydrogen atom (H) is removed from one hydroxyl group (i.e., OH) of a mono- or polyalkanol amine), wherein another hydroxyl group of the polyalkanol amine and the hydroxyl group directly connected with the same titanium atom may cause an intramolecular condensation to form a ring, or another hydroxyl group of the polyalkanol amine and a hydroxyl group directly connected with another titanium atom may cause an intermolecular condensation to form a repeated structure having a repeat number of from 2 to 5; R represents a hydrogen atom, an alkyl group having 1 to 8 carbon atoms, which optionally includes 1 to 3 ether bonds; m is an integer of from 1 to 4, and n is 0 or an integer of from 1 to 3, wherein the total of m and n is 4; and p is 1 or 2, and q is 0 or 1, wherein the total of p and q is 2, and wherein when m or p is 2 or more, each of X is the same as or different from each other.

The added amount of a titanium-containing catalyst (a) is preferably from 0.0001 to 0.8% by weight, more preferably from 0.0002 to 0.6% by weight, and even more preferably from 0.0015 to 0.55% by weight, based on the weight of the resultant polyester resin.

Other esterification catalysts can be added in an amount such that the effect of the titanium-containing catalyst used is not lessened. Specific examples of such esterification catalysts include tin-containing catalysts (e.g., dibutyltin oxide), antimony trioxide, titanium-containing catalysts other than the titanium-containing catalysts (a) (e.g., titanium alkoxides, titanium potassiumoxalate, titanium tetephthalate), zirconium-containing catalysts (e.g., zirconyl acetate), germanium-containing catalysts, alkali (earth) metal catalysts (e.g., alkali metal salts or alkali earth metal salts of carboxylic acids such as lithium acetate, sodium acetate, potassium acetate, calcium acetate, sodium benzoate, and potassium benzoate), zinc acetate, etc. The added amount of such an esterification catalyst is preferably from 0 to 0.6% by weight based on the weight of the resultant polyester resin. In this case, coloring of the resultant polyester resins can be prevented, and therefore such polyester resins can be preferably used for color toners. The content of a titanium-containing catalyst (a) in all the catalysts used is preferably from 50 to 100%.

An example of the method for preparing a linear polyester resin (AX1) is as follows. Specifically, a mixture of a diol (g) and a dicarboxylic acid (i) is heated to a temperature of from 180 to 260° C. in the presence of a titanium-containing catalyst (a) in an amount of from 0.0001 to 0.8% (and another catalyst, if desired) at a normal or reduced pressure to be subjected to a dehydration condensation reaction, resulting in formation of a linear polyester resin (AX1).

An example of the method for preparing a non-linear polyester resin (AX 2 ) is as follows. Specifically, a mixture of a diol (g), a dicarboxylic acid (i) and a polyol (h) is heated to a temperature of from 180 to 260° C. in the presence of a titanium-containing catalyst (a) in an amount of from 0.0001 to 0.8% (and another catalyst, if desired) at anormal or reduced pressure to be subjected to a dehydration condensation reaction. Further, the reaction product is reacted with a polycarboxylic acid (j) to prepare a non-linear polyester resin (AX2). It is possible to react a diol (g), a dicarboxylic acid (i), a polyol (h) and a polycarboxylic acid (j) at the same time.

An example of the method for preparing a modified polyester resin (AY1) is as follows. Specifically, a polyepcxide (c) is added to a polyester resin (AX2), and the mixture is heated to a temperature of from 180 to 260° C. to perform a molecular chain growth reaction, resulting in formation of a modified polyester resin (AY1 ).

In this regard, the acid value of the polyester resin (AX 2 ) used is preferably from 1 to 60 mgKOH/g, and more preferably from 5 to 50 mgKOH/g. When the acid value is not smaller than 1 mgKOH/g, occurrence of a problem in that the polyepoxide (c) remains without being reacted, thereby deteriorating the properties of the resultant polyester resin can be prevented. When the acid value is not larger than 60 mgKOH/g, the resultant polyester resin has good heat stability.

When a modified polyester resin (AY1 ) is prepared, the added amount of the polyepcxide (c) is preferably from 0.01 to 10% by weight, and more preferably from 0.05 to 5% by weight, based on the weight of the polyester resin (AX 2 ) to impart a good combination of low temperature fixability and hot offset resistance to the resultant toner.

The toner of the present invention can include one or more resins other than the above-mentioned polycondensation polyester resins. Specific examples of such resins include styrene resins (e.g., styrene-alkyl (meth)acrylatecopolymers, and styrene-diene monomer copolymers, epoxy resins (e.g., ring-opened polymers of bisphenol A diglycidyl ether), urethane resins (e.g., polyaddition reaction products of a diol and/or a polyol with a diisocyanate), etc.

The added amount of such resins other than polyester resins is preferably from 0 to 40% by weight, more preferably from 0 to 30% by weight, and even more preferably from 0 to 20% by weight, based on the total weight of the binder resin.

Next, crystalline polyester resins for use as binder resins of the toner of the present invention will be explained.

Crystalline polyester resins (A) for use in the toner of the present invention preferably include an ester bond having the following formula (1) in an amount of not less than 60% by mole in the main chain thereof.

$$—OCO—R—COO—(CH_2)_n— \quad (1)$$

wherein R represents a residual group of a linear unsaturated aliphatic dicarboxylic acid, i.e., a linear unsaturated aliphatic group having 2 to 20 carbon atoms, and preferably from 2 to 4 carbon atoms; and n is an integer of from 2 to 20, and preferably from 2 to 6.

Whether an ester bond having formula (1) is present can be determined by using solid $C^{13}$ NMR.

Specific examples of the linear unsaturated aliphatic group include linear unsaturated aliphatic groups derived from linear unsaturated dicarboxylic acids such as maleic acid, fumaric acid, 1,3-n-propenedicarboxylic acid, and 1,4-butenedicarboxylic acid.

In formula (1), the unit "$(CH_2)_n$" represents a residual group of a linear aliphatic dihydric alcohol. Specific examples of the linear aliphatic dihydric alcohols include ethyleneglycol, 1,3-propylene glycol, 1,4-butanediol, 1,6-hexanediol, etc. Since polyester resins (A) are prepared using linear unsaturated dicarboxylic acids as acid components, the polyester resins (A) can form a crystalline structure more easily than polyester resins prepared using aromatic dicarboxylic acids.

Polyester resins (A) can be prepared by subjecting a polycarboxylic acid component including one or more linear unsaturated dicarboxylic acids or their derivatives (e.g., acid anhydrides, lower alkyl (C1-C4) esters and acid halides) and a polyalcohol component including one or more linear aliphatic dihydric alcohols to a polycondensation reaction.

In this regard, the polycarboxylic acid component can include a small amount of polycarboxylic acids other than linear unsaturated dicarboxylic acids or their derivatives. Specific examples of such polycarboxylic acids include (i) branched unsaturated aliphatic dicarboxylic acids, (ii) saturated aliphatic polycarboxylic acids such as saturated aliphatic dicarboxylic acids and saturated aliphatic tricarboxylic acids; and (iii) aromatic polycarboxylic acids such as aromatic dicarboxylic acids and aromatictricarboxylic acids. The added amount of these polycarboxylic acids is not greater than 30% by mole, and preferably not greater than 10% by mole, based on the total of the polycarboxylic acid component so that the resultant polyester resins have crystallinity.

Specific examples of such polycarboxylic acids include dicarboxylic acids such as malonic acid, succinic acid, glutaric acid, adipic acid, suberic acid, sebacic acid, citraconic acid, phthalic acid, isophthalic acid, and terephthalic acid; tri-or more-carboxylic acids such as 1,2,4-benzenetricarboxylic acid, 1,2,5-benzenetricarboxylic acid,
1,2,4-cyclohexanetricarboxylic acid,
1,2,4-naphthalenetricarboxylic acid,
1,2,5-hexanetricarboxylic acid,
1,3-dicarboxyl-2-methylenecarboxypropane, and
1,2,7,8-octanetetracarboxylic acid; etc.

The polyhydric alcohol component can include a small amount of branched aliphatic dihydric alcohols, cyclic dihydric alcohols, and/ortri-or more-hydric alcohols. The added amount of these polyhydric alcohols is not greater than 30% by mole, and preferably not greater than 10% by mole, based on the total of the polyhydric alcohol component so that the resultant polyester resins have crystallinity.

Specific examples of these polyhydric alcohols include 1,4-bis(hydroxymethyl)cyclohexane, polyethylene glycol, ethylene oxide adducts of bisphenol A, propylene oxide adducts of bisphenol A, glycerin, etc.

Crystalline polyester resins (A) for use as binder resins of the toner of the present invention preferably have relatively low molecular weight and sharp molecular weight distribution to impart good low temperature fixability to the toner. Specifically, the weight average molecular weight (Mw) of polyester resins (A) is preferably from 5500 to 6500, the number average molecular weight (Mn) thereof is preferably from 1300 to 1500, and the ratio (Mw/Mn) is preferably from 2 to 5 when the molecular weights Mw and Mn are determined from the molecular weight distribution obtained by subjecting o-dichlorobenzene-soluble components of the polyester resins (A) to gel permeation chromatography (GPC).

The molecular weight distribution is determined from a graph. Specifically, logarithmic molecular weights of components are plotted on the horizontal axis, and weight percentages of the components are plotted on the vertical axis to prepare a molecular weight distribution curve. In this case, it is preferable that the molecular weight peak falls in a molecular weight range of from 3.5 to 4.0 by weight, and the peak has a half width of not greater than 1.5.

The glass transition temperature (Tg) and the softening point $[T(F_{1/2})]$ of crystalline polyester resins (A) for use as binder resins of the toner of the present invention are as low as possible as long as the resultant toner has good high temperature preservability. In general, the glass transition temperature is from 80 to 130° C., and preferably from 80 to 125° C. The softening point $[T(F_{1/2})]$ is generally is from 80 to 130° C., and preferably from 80 to 125° C. When the Tg and $[T(F_{1/2})]$ are too high, the lowest fixable temperature of the toner seriously increases, resulting in deterioration of the low temperature fixability of the toner.

Whether a polyester resin has crystallinity can be determined by subjecting the resin to a powder X-ray diffraction analysis. If the X-ray diffraction spectrum has the following peaks, the polyester resin has crystallinity. Specifically, at least one peak is observed in a Bragg (2θ) angle range of from 20° to 25°. More preferably, a peak is observed in each of Bragg (2θ) angle ranges of (i) from 19° to 20°, (ii) from 21° to 22°, (iii) from 23° to 25°, and (iv) from 29° to 31°.

The powder X-ray diffraction analysis is performed using an instrument RINT1100 from Rigaku Corp. The measurement conditions are as follows.

Target: copper
Voltage: 50 kV
Current: 30 mA
Goniometer: wide angle goniometer

Figure 2:
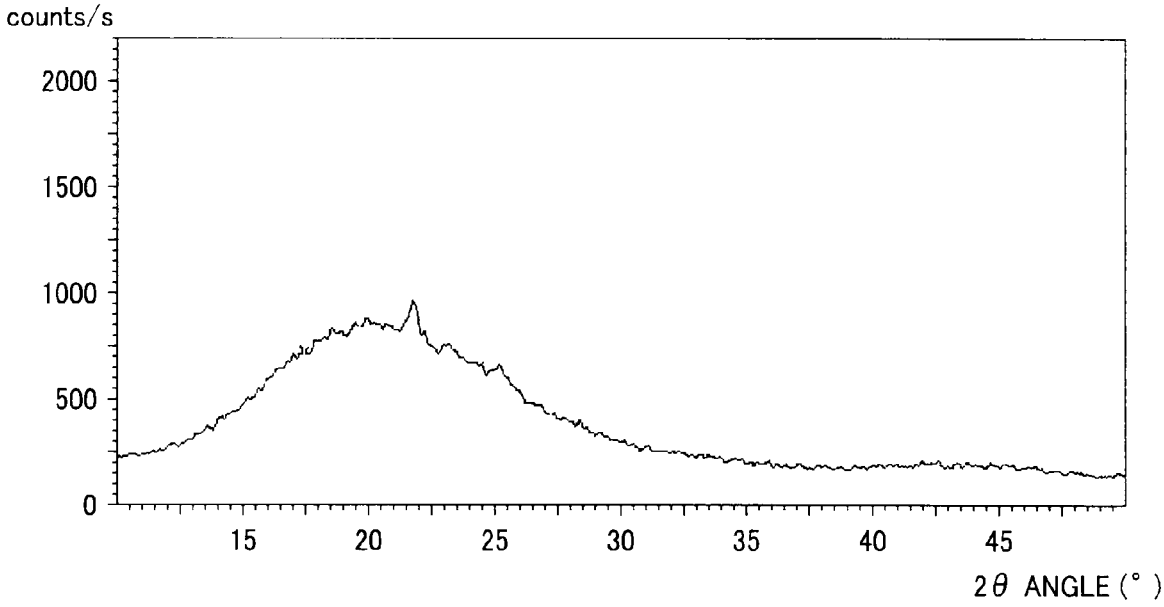
FIG. 2 is an X-ray diffraction spectrum of an example of the toner of the present invention.

FIG. 1 illustrates the X-ray diffraction spectrum of a crystalline polyester resin, and FIG. 2 illustrates the X-ray diffraction spectrum of an example of the toner of the present invention.

When two or more polyester resins are used as binder resins or a combination of one or more polyester resins and one or more other resins is used as binder resins, the resins can be previously mixed without melted or mixed while melted. Alternatively the resins can be mixed in combination with other toner constituents (such as colorants, release agents, and charge controlling agents) are mixed to prepare the toner. When the resins are melted and mixed, the temperature is preferably from 80 to 180° C., more preferably from 100 to 170° C., and even more preferably from 120 to 160° C. When the mixing temperature is too low, the resins cannot be well mixed, and thereby the resins are unevenly present in the toner. When two or more polyester resins are melted at too high a temperature to be mixed, an ester exchange reaction tends to occur, resulting in averaging of the resins. In this case, the resins cannot maintain the properties needed for the toner.

In the melt-mixing process, the mixing time is preferably 10 seconds to 30 minutes, more preferably from 20 seconds to 10 minutes, and even more preferably from 30 seconds to 5 minutes. When the mixing time is too long, an ester exchange reaction tends to occur, resulting in averaging of the resins. Therefore, the resins cannot maintain the properties needed for the toner.

Suitable mixing machines for use in the melt-mixing process include batch mixing machines such as reaction vessels, and continuous mixing machines. Among these mixing machines, continuous mixing machines are preferably used because materials can be evenly mixed at a proper temperature in a short time. Specific examples of the continuous mixing machines include extruders, continuous kneaders, three-roll mills, etc. Among these machines, extruders, and continuous kneaders are preferably used.

When powders (particulate materials) are mixed, mixing is performed under normal mixing conditions using popular mixing machines. For example, the mixing temperature is preferably from 0 to 80° C., and more preferably from 10 to 60° C. The mixing time is preferably not shorter than 3 minutes, and more preferably from 5 to 60 minutes. Specific examples of the mixing machines include HENSCHEL MIXER, NAUTER MIXER, BANBURY MIXER, etc. Among these mixers, HENSCHEL MIXER is preferably used.

Crystalline polyester resins (A) for use in the toner of the present invention preferably have an acid value of not lower than 20 mgKOH/g to impart good affinity for receiving papers to the resultant toner, i.e., to impart good low temperature fixability to the toner. In addition, the acid value is preferably not higher than 45 mgKOH/g to impart good hot offset resistance to the toner.

Further, crystalline polyester resins (A) preferably have a hydroxyl value of from 5 to 50 mgKOH/g to impart a good combination of low temperature fixability and charge property to the toner.

The toner of the present invention preferably includes a fatty acid amide. In this case, the fixability of the toner is dramatically improved. The reason therefor is not determined but is considered to be as follows. Specifically, when a toner image on a receiving material is fixed using a fixing roller on which a silicone oil is applied, the silicone oil is transferred onto the surface of the toner image. In this regard, a fatty acid amide included in the toner prevents the silicone oil from penetrating into the toner image (namely, the silicone oil stays on the surface of the toner image), thereby preventing the releasability of the toner image and preventing deterioration of the properties (such as abrasion resistance) of the fixed toner image due to penetration of the silicone oil into the toner image. When the silicone oil stays on the surface of the fixed toner image over a long period of time, the toner image has good abrasion resistance and the fixed toner image has good fixing property even right after the fixing process.

Users of super high speed image forming apparatus (particularly, users using a roll paper as the receiving material) have a strong need for copy images having good fixing property even right after the copies are discharged from the image forming apparatus. Therefore, it is preferable for the toner to include a fatty acid amide.

Suitable fatty acid amides for use in the toner of the present invention include material shaving a formula, $R^1$—CO—$NR^2R^3$, wherein $R^1$ represents an aliphatic hydrocarbon group having 10 to 30 carbon atoms, and each of $R^2$ and $R^3$ represents a hydrogen atom, an alkyl group having 1 to 10 carbon atoms, an aryl group having 6 to 10 carbon atoms, or an aralkyl group having 7 to 10 carbon atoms. The alkyl group, aryl group and aralkyl group for use as the groups $R^2$ and $R^3$ can include a substituent, which is inactive under normal conditions, such as fluorine atom, chlorine atom, cyano group, alkoxyl group, and alkylthio group. Among these groups for use as the groups $R^2$ and $R^3$, alkyl, aryl, and aralkyl groups without a substituent can be preferably used.

Specific examples of such fatty acid amides include stearamide, stearicacidmethylamide, stearicaciddiethylamide, stearic acid benzylamide, stearic acid pheylamide, behenamide, behenic acid dimethylamide, myristamide, palmitamide, etc.

In the present invention, alkylenebisfatty acid amides having the following formula (2) are preferably used for the toner.

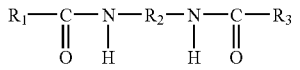

(2)

wherein each of $R_1$ and $R_3$ represents an alkyl group having 5 to 21 carbon atoms, or an alkenyl group having 5 to 21 carbon atoms; and $R_2$ represents an alkylene group having 1 to 20 carbon atoms.

Specific examples of the alkylenebis-saturated-fatty acid amides include methylenebisstearamide, ethylenebisstearamide, methylenebispalmitamide, ethylenebispalmitamide, methylenebisbehenamide, ethylenebisbehenamide, hexamethylenebisstearamide, hexaethylenebispalmitamide, hexamethylenebisbehenamide, etc. Among these materials, ethylenebisstearamide is preferably used.

The fatty acid amide included in the toner preferably has a softening point Tm (i.e., Tsp) lower than the temperature ($T_H$) of the surface of the fixing member of the image forming apparatus. In this case, the fatty acid amide can produce good releasing effect when the toner is contacted with the fixing member.

Other alkylenebisfatty acid amides can also be used for the toner of the present invention. Specific examples thereof include alkylenebis-saturated-fatty acid amides and alkylenebisfatty acid amides having one or two double bonds such as propylenebisstearamide, butylenebisstearamide, methylenebisoleamide, ethylenebisoleamide, propylenebisoleamide, butylenebisoleamide, methylenebislauramide, ethylenebislauramide, propylenebislauramide, butylenebislauramide, methylenebismyristamide, ethylenebismyristamide, propylenebismyristamide, butylenebismyristamide, propylenebispalmitamide, butylenebispalmitamide, methylenebispalmitoleamide, ethylenebispalmitoleamide, propylenebispalmitoleamide, butylenebispalmitoleamide, methylenebisarachamide, ethylenebisarachamide, propylenebisarachamide, butylenebisarachamide, methylenebiseicosenamide, ethylenebiseicosenamide, propylenebiseicosenamide, butylenebiseicosenamide, propylenebisbehenamide, butylenebisbehenamide, methylenebiserucamide, ethylenebiserucamide, propylenebiserucamide, and butylenebiserucamide.

The toner of the present invention can include a wax as a release agent. The wax included in the toner preferably has a melting point of from 70 to 150° C. When the melting point is too low, the resultant toner has poor high temperature preservability. When the melting point is too high, good releasability cannot be imparted to the toner. Known waxes can beusedforthetonerof the present invention. Specific examples of the waxes for use in the toner of the present invention include low molecular weight polyolefin waxes such as polyethylene waxes and polypropylene waxes; synthesized hydrocarbon waxes such as Fischer Tropschwaxes; natural waxes such as beeswaxes, carnauba waxes, candelilla waxes, rice waxes, and montan waxes; petroleum waxes such as paraffin waxes and microcrystalline waxes; higher fatty acids such as stearic acid, palmitic acid and myristic acid, and metal salts and amides of these higher fatty acids; synthesized ester waxes; etc. In addition, modified versions of these waxes can also be used. These waxes mentioned above can be used alone or in combination.

Among these waxes, carnauba waxes, modified carnauba waxes, polyethylene waxes, and synthesize dester waxes can be preferably used. Particularly, pentaerythritol tetrabehenate, which is one of synthesized ester waxes, is preferably used. This is because these waxes can be relatively finely dispersed in polyester resins so as to have a proper particle diameter, and polyol resins, and thereby a good combination of offset resistance, transferability and durability can be imparted to the toner.

The added amount of a wax is preferably from 2 to 15% by weight based on the total weight of the toner. When the added amount is too small, good offset resistance cannot be imparted to the toner. When the added amount is too large, transferability and durability of the toner deteriorate.

The toner of the present invention includes one or more colorants. Any known pigments and dyes capable of imparting a color such as yellow, magenta, cyan and black colors to the toner alone or in combination can be used.

Specific examples of the yellow-color pigments and dyes include Cadmium Yellow, Pigment Yellow 155, benzimidazolone, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOWNCG, Tartrazine Lake, etc.

Specific examples of the orange-color pigments and dyes include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red-color pigment and dyes include red iron oxide, Quinacridone Red, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet-color pigments and dyes include Fast Violet B, and Methyl Violet Lake, etc.

Specific examples of the blue-color pigments and dyes include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green-color pigments and dyes include Chrome Green, chromium oxide, Pigment Green B, Malachite Green Lake, etc.

Specific examples of the black-color pigments and dyes include carbon black, oil furnace black, channel black, lamp black, acetylene black, azine dyes such as aniline black, metal salts of azo dyes, metal oxides, complex metal oxides, etc.

These pigments and dyes can be used alone or in combination.

The toner of the present invention can optionally include a charge controlling agent.

Specific examples of such charge controlling agents include Nigrosine, azine dyes having 2 to 16 carbon atoms (disclosed in published examined Japanese patent application No. (hereinafter referred to as JP-B) 42-1627), basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000)), and lake pigments of these basic dyes, C.I. Solvent Black 8 (C.I. 26150), quaternary ammonium salts (e.g., benzoylmethylhexadecylammonium chloride, and decyltrimethylammonium chloride, dialkyltin compounds (e.g., tibutyltin compounds, and dioctyltin compounds), dialkyltin borate compounds, guanidine derivatives, vinyl polymers having an amino group, condensation polymers having amino group (e.g., polyamine resins), metal complexes of monoazodyes disclosed in JP-Bs41-20153, 43-27596, 44-6397, and 45-26478, metal complexes (e.g., Zn, Al, Co, Cr and Fe complexes) of carboxylic acids (e.g., salicylic acid, dialkylsalicylic acid, naphthoic acid, and dicarboxylic acids), which have been disclosed in JP-Bs 55-42752 and 59-7385, sulfonated copper phthalocyanine pigments, organic boron salts, fluorine-containing quaternary ammonium salts, calixarene compounds, etc. It is preferable not to use charge controlling agents having such a color as to deteriorate the color tone of color toners except for black toners. Namely, salicylic acid derivatives, which have a white color, are preferably used for color toners.

When the toner of the present invention is used for a two-component developer, the toner is mixed with a carrier. In this regard, any known carriers can be used as the carrier. Specific examples of such carriers include iron powders, ferrite powders, magnetite powders, nickel powders, glass beads, etc. The surface of these materials may be covered with a resin, etc. The carriers preferably have a volume average particle diameter of from 25 to 200 μm.

The image forming apparatus of the present invention preferably has a toner container including a developer including the toner of the present invention to store and supply the toner to the developing device. The shape of the toner container is not particularly limited, and any known shapes can be available.

The method for preparing the toner of the present invention is not particularly limited. For example, melt-kneading methods in which the toner constituents (such as binder resins, colorants, release agents, and charge controlling agents) are melt-kneaded and then the kneaded mixture is pulverized to form toner particles (mother toner); polymerizing methods such as suspension or emulsion polymerization methods; addition polymerization methods using an isocyanate-containing prepolymer; methods in which toner constituents are dissolved or dispersed in a solvent, and then the solvent is removed therefrom, followed by pulverization to form toner particles; and melt spray methods in which melted toner constituents are sprayed to form toner particles, can be used. Among these methods, the melt-kneading methods, suspension or emulsion polymerization methods in which a toner composition including a specific crystalline polymer and a polymerizable monomer is dispersed or emulsified in an aqueous medium, followed by polymerization to prepare toner particles; addition polymerization methods in which a toner composition liquid including a specific crystalline polymer and an isocyanate-containing prepolymer is dispersed or emulsified in an aqueous medium, followed by a polymer chain growth reaction and/or a crosslinking reaction using an amine to prepare toner particles; and the methods in which toner constituents are dissolved or dispersed in a solvent are preferably used. Any known methods of these methods can be used.

Suitable kneaders for use in the melt-kneading methods include batch kneaders such as two-roll mills, and BANBURY MIXER; continuous double-axis kneaders such as KTK double-axis extruders from Kobe Steel, Ltd., TEM double-axis extruders from Toshiba Machine Co., Ltd., double-axis extruders from KCK Co., PCM double-axis extruders from Ikegai Corp., and KEX double-axis extruders from Kurimoto, Ltd.; continuous single-axis kneaders such as KO-KNEADER from Buss A.G.; etc.

When the polymerization methods and the addition polymerization methods using an isocyanate-containing prepolymer are used, it is essential to perform a process in which a toner composition liquid is emulsified in an aqueous medium to form liquid droplets by applying mechanical energy thereto. Suitable machines capable of applying such mechanical energy include HOMOMIXER, machines using ultrasound, and high pressure homogenizers (Manton Golin homogenizers), which can perform strong agitation or apply ultrasound vibration energy.

When pulverizing a kneaded toner composition, at first, the kneaded toner composition is crushed with a coarse crusher such as hammer mills, and ROTOPLEX, and the resultant powder (i.e., crushed material) is then pulverized with a fine pulverizer such as pulverizers using a jet air and mechanical pulverizers. In this regard, it is preferable that the pulverized material has an average particle diameter of from 3 to 15 μm. The thus pulverized material is then classified with a classifier such as air classifiers so that the particle diameter is distributed from 5 to 20 μm.

When an external additive (such as inorganic materials and particulate resins) is added, the external additive is mixed with the thus prepared toner particles (mother toner) using a mixer so that the external additive is adhered to the surface of the toner particles while dissociated. In this case, it is preferable that the external additive is evenly and strongly adhered to the toner particles in order to impart good durability to the resultant toner.

In addition, it is preferable to add an external additive step by step to control the free particle ratio of the external additive. Specifically, at first an external additive, which is not easily adhered to the toner particles, is added to the toner particles, and the mixture is agitated. Next, another external additive, which is easily adhered to the toner particles, is added to the mixture of the toner particles and the first external additive to control the free particle ratio (FPR) of the external additives.

The image forming apparatus of the present invention will be explained referring to FIG. 3.

Figure 3:
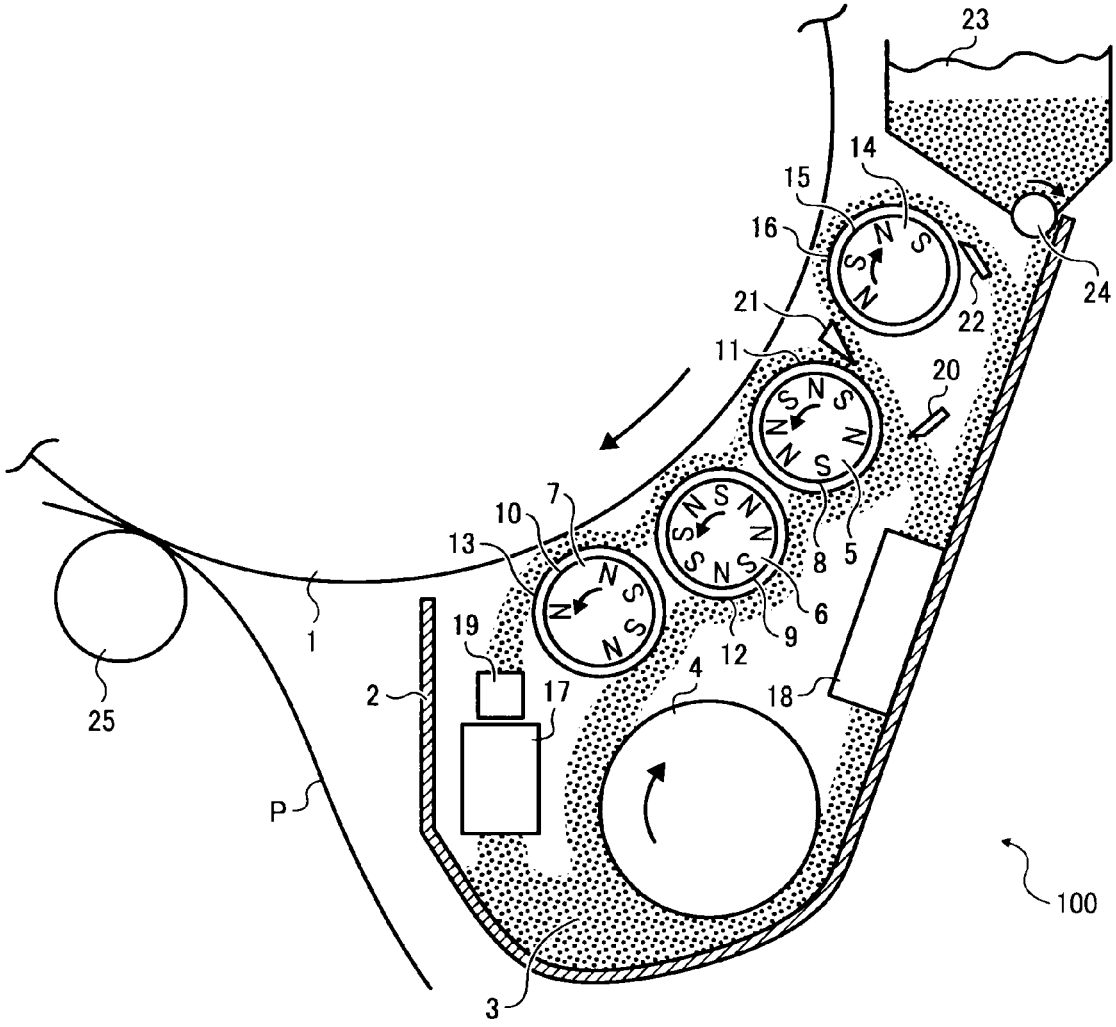
FIG. 3 is a schematic view illustrating the image forming section of an example of the image forming apparatus of the present invention.

FIG. 3 illustrates of an image forming section of the image forming apparatus.

The image forming apparatus includes a photoreceptor 1 serving as an electrostatic image bearing member, a developing device 100, which is opposed to the photoreceptor 1 and is configured to develop an electrostatic image on the photoreceptor to form a toner image on the photoreceptor, and a transfer device 25 configured to transfer the toner image onto a receiving material P.

The developing device 100 includes a developer container 2, three backward developing rollers 5, 6 and 7 which are located in the vicinity of the photoreceptor 1 while opposed to the photoreceptor and which are rotated in a direction opposite to that of the photoreceptor 1, and a forward developing roller 14 which is located on an upstream side from the three backward developing rollers 5, 6 and 7 relative to the rotation direction of the photoreceptor 1 while opposed to the photoreceptor and which is rotated in the same direction as that of the photoreceptor 1. The backward developing rollers 5, 6 and 7 respectively include magnets 8, 9 and 10, each of which has one or two pairs of adjacent magnetic poles having the same polarity, wherein the other two adjacent magnetic poles have the opposite polarities. As illustrated in FIG. 3, the pair of adjacent magnetic poles of the magnet 8 having the same polarity (N in this case) are located so as to be close to the roller 6, the pairs of adjacent magnetic poles of the magnet 9 having the same polarity (N and S in this case) are located so as to be close to the rollers 5 and 7, respectively, and the pair of adjacent magnetic poles of the magnet 10 having the same polarity (S in this case) are located so as to be close to the roller 7. In this regard, the magnets 8, 9 and 10 are fixed. In contrast, any two adjacent magnetic poles of a magnet 15 of the forward developing roller 14 have the opposite polarities. In this regard, the forward developing roller 14 has the same rotation speed as or a rotation speeds lightly higher than that of the backward developing rollers 5, 6 and 7.

Further, the developing device 100 has a developer feeding member 4, which is located in the developer container 2 while opposed to the third backward developing roller 7 and which is rotated in the opposite direction to that of the backward developing roller 7. The developer feeding member 4 is, for example, a roller having a magnetic attraction force to feed a developer 3 in the developer container 2 to the surface of the third backward developing roller 7, which is located on the down most stream side relative to the rotation direction of the photoreceptor 1. The thus fed developer 3 is adhered to the surface of the third backward developing roller 7 due to the magnetic attraction force thereof. Since a sleeve 13 of the third backward developing roller 7 is rotated counter clockwise, the developer 3 adhered to the surface thereof is fed toward the upstream side, i.e., the developer 3 is attracted by the lower surface of the second backward developing roller 6. Similarly, since a sleeve 12 of the second backward developing roller 6 is rotated counterclockwise, the developer 3 adhered to the surface thereof is further fed toward the upstream side, i.e., the developer 3 is attracted by the lower surface of the first backward developing roller 5.

Furthermore, the thus fed developer 3 is fed to the gap formed by the first backward developing roller 5 and the forward developing roller 14 due to counterclockwise rotation of a sleeve 11 or the first developing roller 5 while the thickness of the developer 3 is controlled by a developer amount controlling member 20, which is located below the first developing roller 5 to control the amount of the developer so as to be the total amounts (e.g., 2 mm in thickness) of the developer layer formed on the developing rollers 5, 6 and 7, and the developer layer formed on the developing roller 14.

The developer scraped off by the developer amount controlling member 20 falls in a cross mixer 18, which agitates and returns the scraped-off developer to the lower portion of the developer container 2. On the other hand, the developer fed to the gap formed by the first backward developing roller 5 and the forward developing roller 14 is further fed to the upper surface of the developing roller 14 and the upper surfaces of the developing rollers 5, 6 and 7 to form developer layers thereon while the amounts of the developer layers are controlled (so as to be, for example, 1 mm in thickness) by a developer distribution member 21. The developer fed to the backward developing rollers 5, 6 and 7 are used for developing an electrostatic image formed on the photoreceptor 1 in the opposite-direction developing regions formed by the photoreceptor 1 and the three backward developing rollers 5, 6 and 7.

The developer scraped off by the developer distribution member 21 is adhered to the surface of the forward developing roller 14 while the amount thereof is controlled by the developer distribution member 21 (so as to be, for example, 1 mm in thickness) The developer thus fed to the forward developing roller 14 is used for developing an electrostatic image formed on the photoreceptor 1 in the same-direction developing region formed by the photoreceptor 1 and the forward developing roller 14. The developer passing the same-direction developing region is scraped off by a scraper 22 to fall in the cross mixer 18 to be agitated and returned to the lower portion of the developer container 2.

In contrast, the developer passing the opposite-direction developing regions falls in a toner concentration detector 19 located below the third backward developing roller 7, followed by falling in another cross mixer 17 to be agitated and returned to the lower portion of the developer container 2.

The toner concentration detector 19 outputs a signal on the basis of the concentration of the toner in the developer. When the output signal level is lower than a predetermined level (e.g., 2V), a toner feeding roller 24 of a toner hopper 23, which is located on the developer exit side of the forward developing roller 14, rotates to supply the toner in the toner hopper 23 to the developer container 2 until the output signal level reaches the predetermined level. The thus supplied toner is fed into the cross mixer 17 to be mixed with the developer used for developing electrostatic latent images. The developer mixed with the fresh toner is agitated and contained in the developer container 2.

Thus, the fresh toner, which is supplied by the toner feeding roller 24 located on the uppermost side of the developer container, is mixed with the developer for a relatively long time. Therefore, the toner has sufficient amount of charges, and thereby high quality toner images can be formed. In addition, since the toner concentration detector 19 is provided on the developer exit side of the third backward developing roller located on the downmost stream side of the developer container 2, the toner concentration of the developer can be rapidly detected, namely, the toner supplying operation can be quickly performed in response to a low toner-concentration signal.

Although the developing device illustrated in FIG. 3 has three backward developing rollers and one forward developing roller, the developing device is not limited thereto. The developing device of the image forming apparatus of the present invention includes at least one backward developing roller and one forward developing roller. By using a combination of the toner of the present invention and the image forming apparatus including the developing device having at least one backward developing roller and one forward developing roller, high quality images can be produced even at a high speed.

Figure 4:
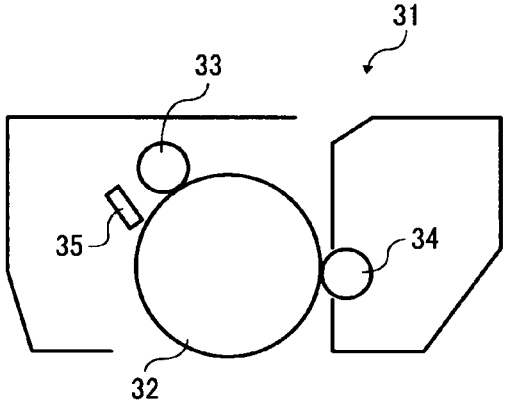
FIG. 4 is a schematic view illustrating an example of the process cartridge of the present invention.

FIG. 4 is a schematic view illustrating an example of the process cartridge of the present invention.

Referring to FIG. 4, a process cartridge 31 includes a photoreceptor 32 serving as an electrostatic latent image bearing member, a charging device 33 configured to charge the photoreceptor 32, a developing device 34 configured to develop the electrostatic latent image with a developer including the toner of the present invention to form a toner image on the photoreceptor 32, and a cleaning device 35 configured to clean the surface of the photoreceptor 32.

The process cartridge of the present invention has a configuration such that at least a photoreceptor and a developing device containing a developer including the toner of the present invention are unitized so as to be detachably attached to an image forming apparatus such as copiers and printers. The process cartridge can optionally include other devices such as charging devices, and cleaning devices.

Having generally described this invention, further understanding can be obtained by reference to certain specific examples which are provided here in for the purpose of illustration only and are not intended to be limiting. In the descriptions in the following examples, the numbers represent weight ratios in parts, unless otherwise specified.

EXAMPLES

<Synthesis of Crystalline Polyester>

The following components were fed into a 5-liter four-necked flask equipped with a nitrogen feed pipe, a dewatering conduit, an agitator and a thermocouple.

| | |
|---|---|
| 1,4-Butanediol | 25 moles |
| Fumaric acid | 23.75 moles |
| Trimellitic anhydride | 1.65 moles |
| Hydroquinone | 5.3 g |

The mixture was reacted for 5 hours at 160° C. under a nitrogen gas flow. The reaction product was heated to 200° C. to be further reacted for 1 hour. In addition, the reaction product was reacted for 1 hour at a pressure of 8.3 KPa. Thus, a crystalline polyester resin No. 1 was prepared. The X-ray diffraction spectrum of the crystalline polyester resin No. 1 is illustrated in FIG. 1.

<Synthesis of Amorphous Polyester Resin>

Synthesis of Titanium-Containing Catalyst (a)

A 80% by weight aqueous solution of titaniumdialkoxybis (triethanolaminate) was fed into a reaction vessel equipped with a condenser, an agitator, and a nitrogen feed pipe capable of bubbling in a liquid. The solution was gradually heated to 90° C. while performing nitrogen gas bubbling in the liquid, followed by a reaction (hydrolysis) for 4 hours at 90° C. Thus, titaniumdihydroxybis(triethanolaminate) (i.e., a titanium-containing catalyst (a)) was prepared.

Synthesis of Linear Polyester Resin (AX1-1)

The following components were fed into a reaction vessel equipped with a condenser, an agitator and a nitrogen feed pipe.

| | |
|---|---|
| Propylene oxide (2 mol) adduct of bisphenol A | 430 parts |
| Propylene oxide (3 mol) adduct of bisphenol A | 300 parts |
| Terephthalic acid | 257 parts |
| Isophthalic acid | 65 parts |
| Maleic anhydride | 10 parts |
| titaniumdihydroxybis(triethanolaminate) (serving as condensation catalyst) | 2 parts |

The mixture was reacted for 10 hours at 220° C. under a nitrogen gas flow while removing generated water, followed by reaction under a reduced pressure of from 5 to 20 mmHg. When the reaction product (i.e., a polyester resin) had an acid value of 5 mgKOH/g, the reaction product was pulled out of the reaction vessel. The reaction product was cooled to room temperature, followed by pulverization. Thus, a linear polyester resin (AX1-1) was prepared.

It was confirmed that the linear polyester resin (AX1-1) includes no tetrahydrofuran (THF)-soluble components, and has an acid value of 7 mgKOH/g, a hydroxyl value of 12 mgKOH/g, a glass transition temperature (Tg) of 60° C., a number average molecular weight (Mn) of 6940, and a peak molecular weight (Mp) of 19100. The content of low molecular weight components having a molecular weight of not greater than 1500 in the resin was 1.2% by weight.

Synthesis of Non-linear Polyester Resin (AX 2-1)

The following components were fed into a reaction vessel equipped with a condenser, an agitator and a nitrogen feed pipe.

| | |
|---|---|
| Ethylene oxide (2 mol) adduct of bisphenol A | 350 parts |
| Propylene oxide (3 mol) adduct of bisphenol A | 326 parts |
| Terephthalic acid | 278 parts |
| Phthalic anhydride | 40 parts |
| titaniumdihydroxybis(triethanolaminate) (serving as condensation catalyst) | 2 parts |

The mixture was reacted for 10 hours at 230° C. under a nitrogen gas flow while removing generated water, followed by reaction under a reduced pressure of from 5 to 20 mmHg. When the reaction product (i.e., a polyester resin) had an acid value of not greater than 2 mgKOH/g, the reaction product was cooled to 180° C., followed by adding 62 parts of trimellitic anhydride there to. The mixture was reacted for 2 hours at a normal pressure while the vessel was sealed. After being pulled out of the reaction vessel, the reaction product was cooled to room temperature, followed by pulverization. Thus, a non-linear polyester resin (AX 2-1) was prepared.

It was confirmed that the non-linear polyester resin (AX 2-1) includes no THF-soluble components, and has an acid value of 35 mgKOH/g, a hydroxyl value of 17 mgKOH/g, a glass transition temperature (Tg) of 69° C., a number average molecular weight (Mn) of 3920, and a peak molecular weight (Mp) of 11200. The content of low molecular weight components having a molecular weight of less than 1500 in the resin was 0.9% by weight.

<Preparation of Amorphous Polyester Resin A>

Four hundred (400) parts of the linear polyester resin (AX1-1) and 600 parts of the non-linear polyester resin (AX 2 -1) were melt-kneaded using a continuous kneader under conditions of 150° C. in jacket temperature and 3 minutes in kneading time during which the mixed resins stay in the kneader. The melted and kneaded resin mixture was then cooled to 30° C. over 4 minutes using a steel belt. Thus, an amorphous polyester resin A was prepared.

Example 1

<Preparation of Toner using Kneading/Pulverizing Method>

The following components were mixed using a blender.

| | |
|---|---|
| Crystalline polyester resin No. 1 | 35 parts |
| Amorphous polyester resin A | 65 parts |
| Carnauba wax (melting point of 81° C.) | 5 parts |
| Fatty acid amide compound (ethylenebisstearamide) | 5 parts |
| Nigrosine (charge controlling agent) | 2 parts |
| Carbon black (colorant) | 6 parts |

The mixture was melt-kneaded using a double-axis extruder under the following conditions:

Kneading temperature: 140° C.

Extruding speed: 10 kg/hour

Pressing gap formed by two rollers: 2 mm

Interval between kneading and pulverizing: 48 hours

The kneaded mixture was pulverized and the resultant powder was classified to prepare a mother toner (toner particles) having a volume average particle diameter of 7.6 μm.

The following components were mixed using a HENSCHEL MIXER mixer.

| | |
|---|---|
| Mother toner prepared above | 100 parts |
| External additives | |
| Fatty acid metal salt (zinc stearate, average primary particle diameter of 0.5 μm) | 0.05 parts |
| Positively chargeable silica | 0.5 parts |
| Negatively chargeable silica | 0.5 parts |

The mixing conditions were as follows.

Rotation speed of mixer: 1500 rpm

Mixing operation: A cycle in which mixing is performed for 60 seconds, followed by pause for 60 seconds was repeated 8 times.

Thus, a black-color toner of Example 1 was prepared.

<Preparation of Developer>

Preparation of Carrier

The following components were mixed for 10 minutes using a HOMOMIXER mixer to prepare a coating liquid.

| | |
|---|---|
| Silicone resin solution (SR2410 from Dow Corning Toray Silicone Oil Co., Ltd, solid content of 23% by weight) | 132.2 parts |
| Amino silane (SH6020 from Dow Corning Toray Silicone Oil Co., Ltd, solid content of 100% by weight) | 0.66 parts |

-continued

| | |
|---|---|
| Particulate electroconductive material (core: alumina; lower cover layer: tin dioxide; upper cover layer: indium oxide including tin dioxide; average particle diameter; 0.35 μm; resistivity of particles: 3.5 Ω · cm) | 31 parts |
| Toluene | 300 parts |

The thus prepared coating liquid was coated on a calcined particulate ferrite having a volume average particle diameter of 70 μm using SPIRA COTA (from Okada Seiko Co., Ltd.), which was heated to 40° C., so that the coated layer has a thickness of 0.15 μm on a dry basis. The thus coated carrier was calcined in an electric furnace heated to 300° C., followed by filtering while being dissociated using a screen with openings of 125 μm. Thus a carrier No. 1 was prepared.

Preparation of Developer

The following components were mixed to prepare a two-component developer No. 1.

| | |
|---|---|
| Toner prepared above | 4 parts |
| Carrier No. 1 prepared above | 96 parts |

<Evaluation of Toner>

1. Image Density

The above-prepared developer No. 1 was set in an image forming apparatus, i.e., modified IMAGIO NEO C600 from Ricoh Co., Ltd. having a developing device as illustrated in FIG. 3, and a 100,000-copy running test in which 50,000 copies are produced per day was performed. In this regard, a copy of a predetermined original image was produced before and after the running test to evaluate the image density of the copies. The image forming conditions were as follows.

Linear system speed: 1700 mm/sec

Development gap: 1.26 mm

Doctor blade gap: 1.6 mm

Reflection photo-sensor: off

Temperatures of photoreceptor, developing device and transfer device: The temperature was controlled in a range of from 30 to 48° C.

In this regard, the linear system speed is defined as follows. Specifically, 100 sheets of an A-4 size receiving paper are continuously fed in a portrait direction such that the feeding direction is parallel to the longitudinal direction (297 mm in length per sheet) of the A-4 paper to measure the total copying time A (seconds). The linear system speed (B) is defined by the following equation:

$$B\ (\text{mm/sec})=100\ (\text{sheets})\times 297\ (\text{mm})/A\ (\text{sec})$$

The image density was measured with a densitometer from MACBETH Co., and the image density evaluation was performed as follows.

○: The image density of the 100,000$^{th}$ image is from 1.2 to 1.5.

Δ: The image density of the 100,000$^{th}$ image is not lower than 0.8 and lower than 1.2.

X: The image density of the 100,000$^{th}$ image is not lower than 0.5 and lower than 0.8.

2. Filming

After the running test mentioned above, the surface of the photoreceptor was visually observed to determine whether a toner film is formed thereon. The filming evaluation was performed as follows.

○: No film is formed on the surface of the photoreceptor.

Δ: A thin film is formed on the surface of the photoreceptor.

X: A thick film is formed on the surface of the photoreceptor.

The evaluation results of the toner of Example 1 are shown in Tables 1-1 and 1-2.

Example 2

The procedure for preparation and evaluation of the toner in Example 1 was repeated except that the external additives of the toner were replaced with the following.

| External additives | |
|---|---|
| Fatty acid metal salt (zinc stearate, average primary particle diameter of 1.5 μm) | 0.05 parts |
| Positively chargeable silica | 1.0 part |
| Negatively chargeable silica | 1.0 part |

The evaluation results of the toner of Example 2 are shown in Tables 1-1 and 1-2.

Example 3

The procedure for preparation and evaluation of the toner in Example 1 was repeated except that the external additives of the toner were replaced with the following.

| External additives | |
|---|---|
| Fatty acid metal salt (zinc stearate, average primary particle diameter of 1.0 μm) | 0.05 parts |
| Positively chargeable silica | 1.0 part |
| Negatively chargeable titanium oxide | 1.0 part |

The evaluation results of the toner of Example 3 are shown in Tables 1-1 and 1-2.

Example 4

The procedure for preparation and evaluation of the toner in Example 1 was repeated except that the linear system speed of the image forming apparatus used for evaluation of the toner was changed to 500 mm/sec.

The evaluation results of the toner in Example 4 are shown in Tables 1-1 and 1-2.

Comparative Example 1

The procedure for preparation and evaluation of the toner in Example 1 was repeated except that the external additives of the toner were replaced with the following.

| External additives | |
|---|---|
| Fatty acid metal salt (zinc stearate, average primary particle diameter of 1.6 μm) | 0.05 parts |
| Positively chargeable silica | 0.5 part |
| Negatively chargeable silica | 0.5 part |

The evaluation results of the toner of Comparative Example 1 are shown in Tables 1-1 and 1-2.

Comparative Example 2

The procedure for preparation and evaluation of the toner in Example 1 was repeated except that the external additives of the toner were replaced with the following.

| External additive | |
|---|---|
| Fatty acid metal salt (zinc stearate, average primary particle diameter of 0.4 μm) | 0.05 parts |
| Positively chargeable silica | 0.5 part |
| Negatively chargeable silica | 0.5 part |

The evaluation results of the toner of Comparative Example 2 are shown in Tables 1-1 and 1-2.

Comparative Example 3

The procedure for preparation and evaluation of the toner in Example 1 was repeated except that the external additives of the toner were replaced with the following.

| External additives | |
|---|---|
| Fatty acid metal salt (zinc stearate, average primary particle diameter of 0.5 μm) | 0.05 parts |
| Negatively chargeable silica | 0.5 part |

The evaluation results of the toner of Comparative Example 3 are shown in Tables 1-1 and 1-2.

Comparative Example 4

The procedure for preparation and evaluation of the toner in Example 1 was repeated except that the external additives of the toner were replaced with the following.

| External additives | |
|---|---|
| Fatty acid metal salt (zinc stearate, average primary particle diameter of 0.5 μm) | 0.05 parts |
| Positively chargeable silica | 0.5 part |

The evaluation results of the toner of Comparative Example 4 are shown in Tables 1-1 and 1-2.

TABLE 1-1

| | Fatty acid metal salt | | | PCIM* | NCIM** |
|---|---|---|---|---|---|
| | Particle diameter (μm) | Added amount (part) | Free particle ratio (%) | (added amount (part)) | (added amount (part)) |
| Ex. 1 | 0.5 | 0.05 | 17 | Silica (0.5) | Silica (0.5) |
| Ex. 2 | 1.5 | 0.05 | 16 | Silica (1.0) | Silica (1.0) |
| Ex. 3 | 1.0 | 0.05 | 16 | Silica (1.0) | Titanium oxide (1.0) |
| Ex. 4 | 0.5 | 0.05 | 17 | Silica (0.5) | Silica (0.5) |
| Comp. Ex. 1 | 1.6 | 0.05 | 22 | Silica (0.5) | Silica (0.5) |
| Comp. Ex. 2 | 0.4 | 0.05 | 8 | Silica (0.5) | Silica (0.5) |
| Comp. Ex. 3 | 0.5 | 0.05 | 17 | — | Silica (0.5) |
| Comp. Ex. 4 | 0.5 | 0.05 | 17 | Silica (0.5) | — |

PCIM*: Positively chargeable inorganic material
NCIM**: Negatively chargeable inorganic material

TABLE 1-2

| | Linear system speed (mm/s) | Image density | Filming |
|---|---|---|---|
| Ex. 1 | 1700 | ○ | ○ |
| Ex. 2 | 1700 | ○ | ○ |
| Ex. 3 | 1700 | ○ | ○ |
| Ex. 4 | 500 | ○ | ○ |
| Comp. Ex. 1 | 1700 | ○ | X |
| Comp. Ex. 2 | 1700 | ○ | X |
| Comp. Ex. 3 | 1700 | ○ | X |
| Comp. Ex. 4 | 1700 | ○ | X |

It is clear from Tables 1-1 and 1-2 that the toner of the present invention can produce high quality images for a long period of time even when the linear system speed is high (i.e., from 500 to 1700 mm/sec).

Example 5

<Preparation of Toner using Kneading/Pulverizing Method>

The following components were mixed using a blender.

| | |
|---|---|
| Crystalline polyester resin No. 1 | 35 parts |
| Amorphous polyester resin A | 65 parts |
| Carnauba wax (melting point of 81° C.) | 5 parts |
| Fatty acid amide compound (ethylenebisstearamide) | 5 parts |
| Nigrosine (charge controlling agent) | 2 parts |
| Carbon black (colorant) | 6 parts |

The mixture was melt-kneaded using a double-axis extruder under the following conditions:

Kneading temperature: 140° C.

Extruding speed: 10 kg/hour

Pressing gap formed by two rollers: 2 mm

Interval between kneading and pulverizing: 48 hours

The kneaded mixture was pulverized and the resultant powder was classified to prepare a mother toner having a volume average particle diameter of 7.6 μm.

The following components were mixed using a HENSCHEL MIXER mixer.

| | |
|---|---|
| Mother toner prepared above | 100 parts |
| External additives | |
| Fatty acid metal salt (zinc stearate, average primary particle diameter of 0.5 μm) | 0.02 parts |
| Positively chargeable silica | 0.5 parts |
| Negatively chargeable silica | 0.5 parts |

The mixing conditions were as follows.

Rotation speed of mixer: 1500 rpm

Mixing operation: A cycle in which mixing is performed for 60 seconds, followed by pause for 60 seconds was repeated 4 times.

Thus, a black-color toner of Example 5 was prepared.

The toner of Example 5 was evaluated by the methods mentioned above in Example 1. The evaluation results are shown in Tables 2-1 and 2-2.

Example 6

<Preparation of Toner using Kneading/Pulverizing Method>

The following components were mixed using a blender.

| | |
|---|---|
| Crystalline polyester resin No. 1 | 35 parts |
| Amorphous polyester resin A | 65 parts |
| Carnauba wax (melting point of 81° C.) | 5 parts |
| Fatty acid amide compound (ethylenebisstearamide) | 5 parts |
| Nigrosine (charge controlling agent) | 2 parts |
| Carbon black (colorant) | 6 parts |

The mixture was melt-kneaded using a double-axis extruder under the following conditions:

Kneading temperature: 140° C.

Extruding speed: 10 kg/hour

Pressing gap formed by two rollers: 2 mm

Interval between kneading and pulverizing: 48 hours

The kneaded mixture was pulverized and the resultant powder was classified to prepare a mother toner having a volume average particle diameter of 7.6 μm.

The following components were mixed using a HENSCHEL MIXER mixer.

| | |
|---|---|
| Mother toner prepared above | 100 parts |
| External additives | |
| Fatty acid metal salt (zinc stearate, average primary particle diameter of 0.5 μm) | 0.06 parts |
| Positively chargeable silica | 0.5 parts |
| Negatively chargeable silica | 0.5 parts |

The mixing conditions were as follows.

Rotation speed of mixer: 1500 rpm

Mixing operation: A cycle in which mixing is performed for 60 seconds, followed by pause for 60 seconds was repeated 8 times. In this regard, in the first and second cycles, only the fatty acid metal salt was mixed with the mother toner, and in the third to eighth cycles, the positively chargeable silica and negatively chargeable silica were mixed therewith.

Thus, a black-color toner of Example 6 was prepared.

The toner of Example 6 was evaluated by the methods mentioned above in Example 1. The evaluation results are shown in Tables 2-1 and 2-2.

Example 7

<Preparation of Toner using Kneading/Pulverizing Method>

The following components were mixed using a blender.

| | |
|---|---|
| Crystalline polyester resin No. 1 | 35 parts |
| Amorphous polyester resin A | 65 parts |
| Carnauba wax (melting point of 81° C.) | 5 parts |
| Fatty acid amide compound (ethylenebisstearamide) | 5 parts |
| Nigrosine (charge controlling agent) | 2 parts |
| Carbon black (colorant) | 6 parts |

The mixture was melt-kneaded using a double-axis extruder under the following conditions:

Kneading temperature: 140° C.

Extruding speed: 10 kg/hour

Pressing gap formed by two rollers: 2 mm

Interval between kneading and pulverizing: 48 hours

The kneaded mixture was pulverized and the resultant powder was classified to prepare a mother toner having a volume average particle diameter of 7.6 μm.

The following components were mixed using a HENSCHEL MIXER mixer.

| | |
|---|---|
| Mother toner prepared above | 100 parts |
| External additives | |
| Fatty acid metal salt (zinc stearate, average primary particle diameter of 0.5 μm) | 0.01 parts |
| Positively chargeable silica | 0.5 parts |
| Negatively chargeable silica | 0.5 parts |

The mixing conditions were as follows.

Rotation speed of mixer: 1500 rpm

Mixing operation: A cycle in which mixing is performed for 60 seconds, followed by pause for 60 seconds was repeated 8 times. In this regard, in the first and second cycles, only the fatty acid metal salt was mixed with the mother toner, and in the third to eighth cycles, the positively chargeable silica and negatively chargeable silica were mixed therewith.

Thus, a black-color toner of Example 7 was prepared.

The toner of Example 7 was evaluated by the methods mentioned above in Example 1. The evaluation results are shown in Tables 2-1 and 2-2.

Example 8

<Preparation of Toner using Kneading/Pulverizing Method>

The following components were mixed using a blender.

| | |
|---|---|
| Crystalline polyester resin No. 1 | 35 parts |
| Amorphous polyester resin A | 65 parts |
| Carnauba wax (melting point of 81° C.) | 5 parts |
| Fatty acid amide compound (ethylenebisstearamide) | 5 parts |
| Nigrosine (charge controlling agent) | 2 parts |
| Carbon black (colorant) | 6 parts |

The mixture was melt-kneaded using a double-axis extruder under the following conditions:

Kneading temperature: 140° C.

Extruding speed: 10 kg/hour

Pressing gap formed by two rollers: 2 mm

Interval between kneading and pulverizing: 48 hours

The kneaded mixture was pulverized and the resultant powder was classified to prepare a mother toner having a volume average particle diameter of 7.6 μm.

The following components were mixed using a HENSCHEL MIXER mixer.

| | |
|---|---|
| Mother toner prepared above | 100 parts |
| External additives | |

-continued

| | |
|---|---|
| Fatty acid metal salt (zinc stearate, average primary particle diameter of 0.5 μm) | 0.07 parts |
| Positively chargeable silica | 0.5 parts |
| Negatively chargeable silica | 0.5 parts |

The mixing conditions were as follows.

Rotation speed of mixer: 1500 rpm

Mixing operation: A cycle in which mixing is performed for 60 seconds, followed by pause for 60 seconds was repeated 4 times.

Thus, a black-color toner of Example 8 was prepared.

The toner of Example 8 was evaluated by the methods mentioned above in Example 1. The evaluation results are shown in Tables 2-1 and 2-2.

TABLE 2-1

| | Fatty acid metal salt | | | PCIM* | NCIM** |
|---|---|---|---|---|---|
| | Particle diameter (μm) | Added amount (part) | Free particle ratio (%) | (added amount (part)) | (added amount (part)) |
| Ex. 5 | 0.5 | 0.02 | 10 | Silica (0.5) | Silica (0.5) |
| Ex. 6 | 0.5 | 0.06 | 20 | Silica (0.5) | Silica (0.5) |
| Ex. 7 | 0.5 | 0.01 | 5 | Silica (0.5) | Silica (0.5) |
| Ex. 8 | 0.5 | 0.07 | 29 | Silica (0.5) | Silica (0.5) |

PCIM*: Positively chargeable inorganic material

NCIM**: Negatively chargeable inorganic material

TABLE 2-2

| | Linear system speed (mm/s) | Image density | Filming |
|---|---|---|---|
| Ex. 5 | 1700 | ○ | ○ |
| Ex. 6 | 1700 | ○ | ○ |
| Ex. 7 | 1700 | ○ | Δ |
| Ex. 8 | 1700 | ○ | Δ |

It is clear from Tables 2-1 and 2-2 that the added amount of the fatty acid metal salt is preferably from 0.02 to 0.06 parts by weight, and the free particle ratio is preferably from 10 to 20%.

This document claims priority and contains subject matter related to Japanese Patent Applications Nos. 2008-041105, and 2008-293063, filed on Feb. 22, 2008, and Nov. 17, 2008, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles; and external additives including:

a fatty acid metal salt having an average primary particle diameter of from 0.5 to 1.5 μm;

a positively chargeable particulate inorganic material; and a negatively chargeable particulate inorganic material, wherein the fatty acid metal salt is included in the toner in an amount of from 0.02 parts by weight to 0.06 parts by weight per 100 parts by weight of the toner particles, and the fatty acid metal salt has a free particle ratio of from 10% by weight to 20% by weight.

2. The toner according to claim 1, wherein the fatty acid metal salt includes at least one member selected from the group consisting of zinc stearate, zinc laurate, zinc myristate, calcium stearate, and aluminum stearate.

3. The toner according to claim 1, wherein the positively chargeable inorganic material includes at least one member selected from the group consisting of positively chargeable silica and positively chargeable titanium oxide.

4. The toner according to claim 1, wherein the negatively chargeable inorganic material includes at least one member selected from the group consisting of negatively chargeable silica and negatively chargeable titanium oxide.

5. The toner according to claim 1, wherein the toner particles include a fatty acid amide compound.

6. An image forming method comprising:

forming an electrostatic image on a photoreceptor;

developing the electrostatic image using a center feed developing device, which develops the electrostatic image using a developer including the toner according to claim 1 to form a toner image on the photoreceptor and which includes:

at least two developing rollers each having a magnetic attraction force, wherein the at least two developing rollers are opposed to the photoreceptor and rotated in directions opposite to each other; and a developer layer controlling member configured to form a developer layer on each of the at least two developing rollers; and transferring the toner image onto a receiving material.

7. The image forming method according to claim 6, wherein the transferring step comprises:

transferring the toner image onto a receiving material while feeding the receiving material at a linear system speed of from 500 to 1700 mm/s.

* * * * *